United States Patent [19]

Rashbaum

[11] 4,278,280

[45] Jul. 14, 1981

[54] LOCKABLE AUTOMOBILE TRUNK EXTENSION

[76] Inventor: Abraham Rashbaum, 199-29 22nd Ave., Whitestone, N.Y. 11357

[21] Appl. No.: 81,643

[22] Filed: Oct. 4, 1979

[51] Int. Cl.[3] ..... E05C 17/32

[52] U.S. Cl. ..... 292/263; 292/338

[58] Field of Search ..... 292/262, 263, 258, 288, 292/338, 339

[56] References Cited

U.S. PATENT DOCUMENTS

| | | | |
|---|---|---|---|
| 1,002,812 | 9/1911 | Moore | 292/338 |
| 3,195,940 | 7/1965 | Woodling | 292/262 |
| 4,070,050 | 1/1978 | Glock et al. | 292/339 |

*Primary Examiner*—Richard E. Moore

*Attorney, Agent, or Firm*—Arthur B. Colvin

[57] ABSTRACT

The present invention is directed to an extension mechanism adapted to be interposed between the fixed strike plate of an automobile trunk and the lock elements of the trunk lid. The device enables the trunk lid to be locked at any of a series of partially ajar positions whereby cargoes of a variety of sizes may be readily transported with safety and security.

3 Claims, 8 Drawing Figures

LOCKABLE AUTOMOBILE TRUNK EXTENSION

BACKGROUND OF THE INVENTION

1. Field of the Invention

The present invention is directed to improvements in security devices for automobiles, and more particularly pertains to an extension mechanism adapted to be connected between the strike and lock mechanism of an automobile trunk assembly whereby the trunk lid may be locked in any of a series of ajar positions.

2. The Prior Art

It is frequently necessary to transport in the trunk of an automobile articles the dimensions of which preclude closing the trunk lid. It is commonplace under such circumstances to utilize ropes, elastic ties or the like spanning the partially opened trunk lid and a fixed portion of the automobile as the means for maintaining the lid in a partially ajar position. The use of ties or ropes is unsatisfactory from a number of standpoints. In particular, the rope urges the trunk lid against the article being transported, with a consequent likelihood of damage to the article. Where the automobile traverses a bumpy road, the inertia of the trunk causes an up and down movement, with frequent collisions between the article and the trunk lid which is biased against the article, with consequent enhancing of the likelihood of damage to the article.

Additionally, ropes or ties will normally chafe through in short order, resulting in a release of the trunk lid.

A most significant disadvantage inhering in the use of ties or ropes is that the same provide virtually no security to the articles being transported, the latter being subject to abstraction by merely cutting the binding.

Numerous expedients have been suggested for overcoming the noted advantages. By way of example reference is made to the following U.S. Pat. Nos. 137,647, Anderson; 843,111, Sachse; 1,348,260 Boyer; 1,543,156, Gibson; 2,618,497, Gardels; 2,919,946, Miener; 2,973,217, Gregoire; 3,112,910, Bal; 3,117,689, Dedic; 3,171,627, Tapley; 3,180,668, Brown; 3,195,940, Woodling; 3,216,605, Hughes; 3,674,299, Kelley; 3,971,589, Elrod; and 4,124,240, Adelberg.

Referring particularly to U.S. Pat. No. 2,618,497, there is disclosed a means adaptable to a particular automobile configuration wherein the trunk lid may be held in ajar position. The extension of the subject reference, however, is disadvantageous in several aspects, notably, the device is susceptible of holding the trunk lid at only a fixed ajar position. Additionally, even in the applied position of the extension, a substantial amount of relative movement is permitted between the trunk lid and the trunk proper. Also, the noted prior art device must be fabricated in a manner especially adapted to each make or model of automobile.

SUMMARY OF THE INVENTION

The present invention may be summarized as directed to an improved lockable extension adapted to be interposed between the trunk lid and the strike plate of an automobile, the device being accommodated to any of a variety of automotive devices, locking and unlocking of the device being accomplished using the existing mechanism of the automobile trunk lid.

The device may be adapted to hold the trunk lid in any of a multiplicity of ajar positions and is engaged with the automobile assembly in such manner as to avoid rattling or looseness of the parts.

More particularly, the extension device comprises a strut member which is longitudinally extensible and which includes one or more (preferably two) knuckle joints or pivots, permitting the ends of the strut assembly to be pivoted relative to the main body portion thereof, such pivotal movement being restricted to a given plane coincident with the plane of the strut.

One end of the strut assembly includes a clamp means adapted to be connected to the strike plate assembly of the automobile when in a tilted position, the clamp assembly being captured behind the strike plate when the assembly is restored to a vertical position. The other end of the strut assembly includes lock receiver means adapted to encompass the latch bolt of the automobile trunk lid assembly.

In the engaged position of the latch bolt and latch bolt receiver means, the strut is prevented from tilting from the vertical and thus the clamp plate may not be removed from the strike plate assembly unless the connection between the trunk lock assembly and the strut is released by one in possession of a key to the lock device.

Accordingly, it is an object of the invention to provide a lockable extension adapted to maintain the lid of an automobile trunk in any of a series of ajar positions.

A further object of the invention is the provision of a device of the type described which prevents opening of the trunk lid without the use of the conventional trunk lid operating key.

A further object of the invention is the provision of a device of the type described wherein the connections between the extremities of the extension mechanism and the trunk lid on the one hand and the strike plate on the other are tight, so as to prevent rattling in use.

Still a further object of the invention is the provision of a device of the type described which is highly versatile in its operation in that the same is adapted to be connected to existing trunk latching components of a wide variety of automobiles.

To attain these objects and such further objects as may appear herein or be hereinafter pointed out, reference is made to the accompanying drawings, forming a part hereof, in which.

Figure 3:
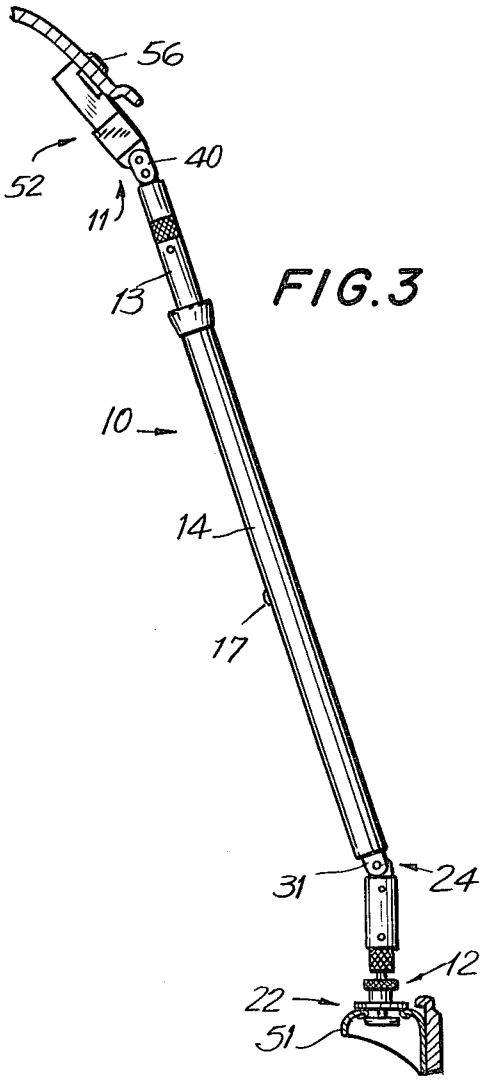
FIG. 3 is a sectional view taken on the line 3—3 of FIG. 2.
Figure 2:
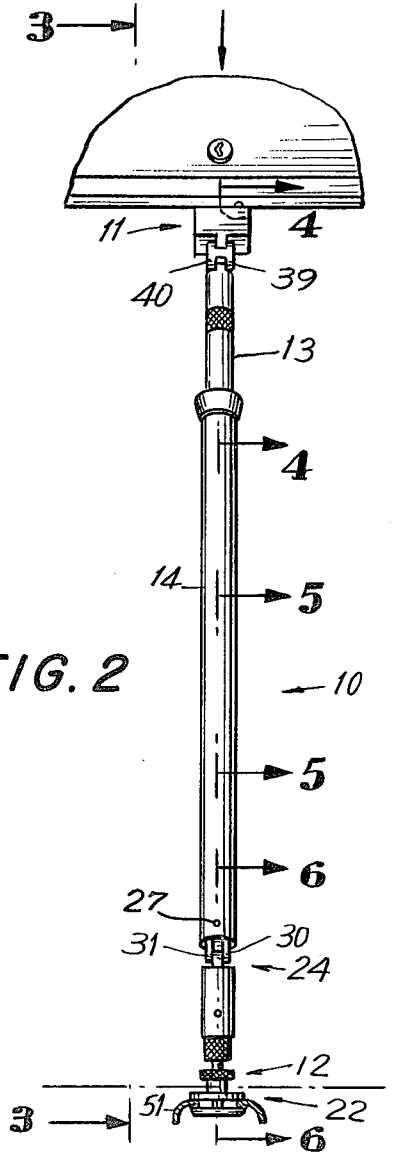
FIGS. 1 and 2 are rear elevational views, partially in section, of an extension device in accordance with the invention, respectively in the partially applied and fully applied positions thereof, such views showing the orientation of the parts relative to the trunk lid assembly of an automobile.

Referring now to the drawings, there is disclosed a trunk lid extension comprising generally a strut assembly 10 having a trunk lid engaging portion 11 at its upper end and a strike plate engaging portion 12 at its lower end.

Figure 5:
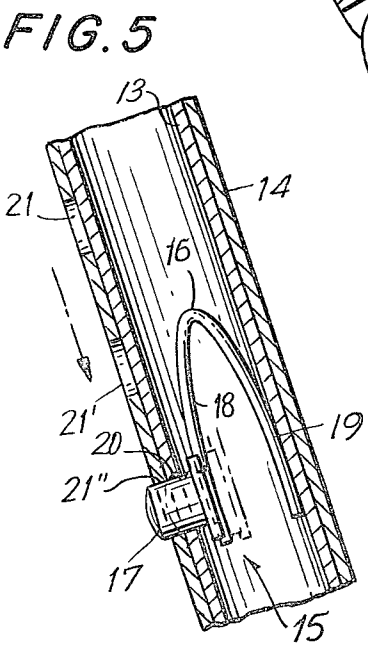
FIG. 5 is a magnified fragmentary section taken on the line 5—5 of FIG. 2.

The strut assembly 10 is preferably comprised of an upper tubular section 13 telescopically slidably received within the lower strut section. The sections 13 and 14 may be extended longitudinally relative to each other as by a spring latching mechanism 15 (FIG. 5). The latching mechanism 15 may include a bent leaf spring 16 having a latch button 17 fixed to one leg 18 thereof, the opposite leg 19 of the spring being biased against an inner wall of the tubular section 13. An aperture 20 is formed in the wall of the tubular section 13 diametrically opposite the leg 19. The outer tube 14 is provided with a series of longitudinally spaced-apart throughgoing apertures 21, 21', 21'', etc.

It will be observed that longitudinally to adjust the overlap of the tubes 13, 14, the button 17 is depressed to a position inwardly of the outer tube 14. The tubes 13, 14 may then be readily slid longitudinally until the button end is disposed adjacent the desired aperture 21, 21', 21'', whereupon the button will spring back to a spanning position of the apertures 20 and 21'', for example, locking the tubes in the noted relatively extended position.

Figure 6:
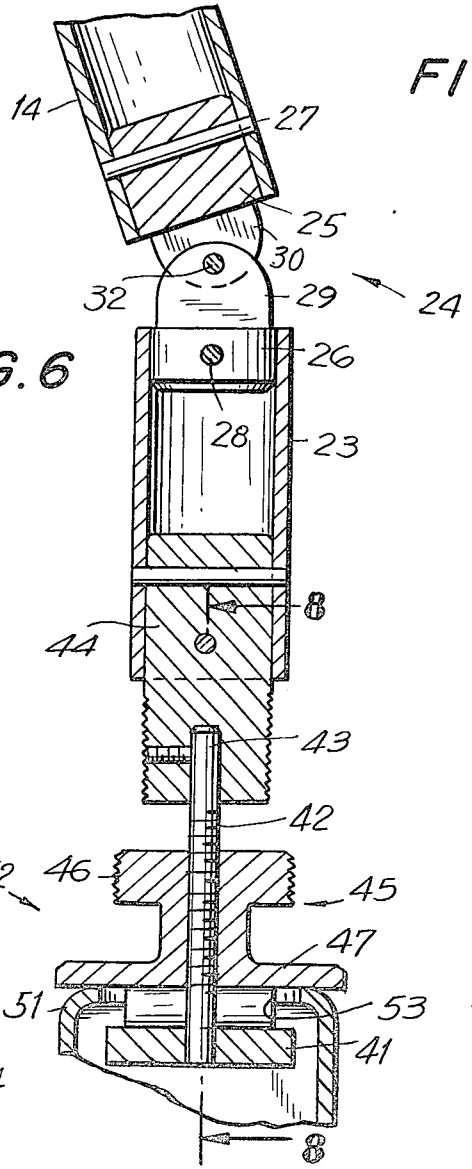
FIG. 6 is a magnified fragmentary section taken on the line 6—6 of FIG. 2.
Figure 4:
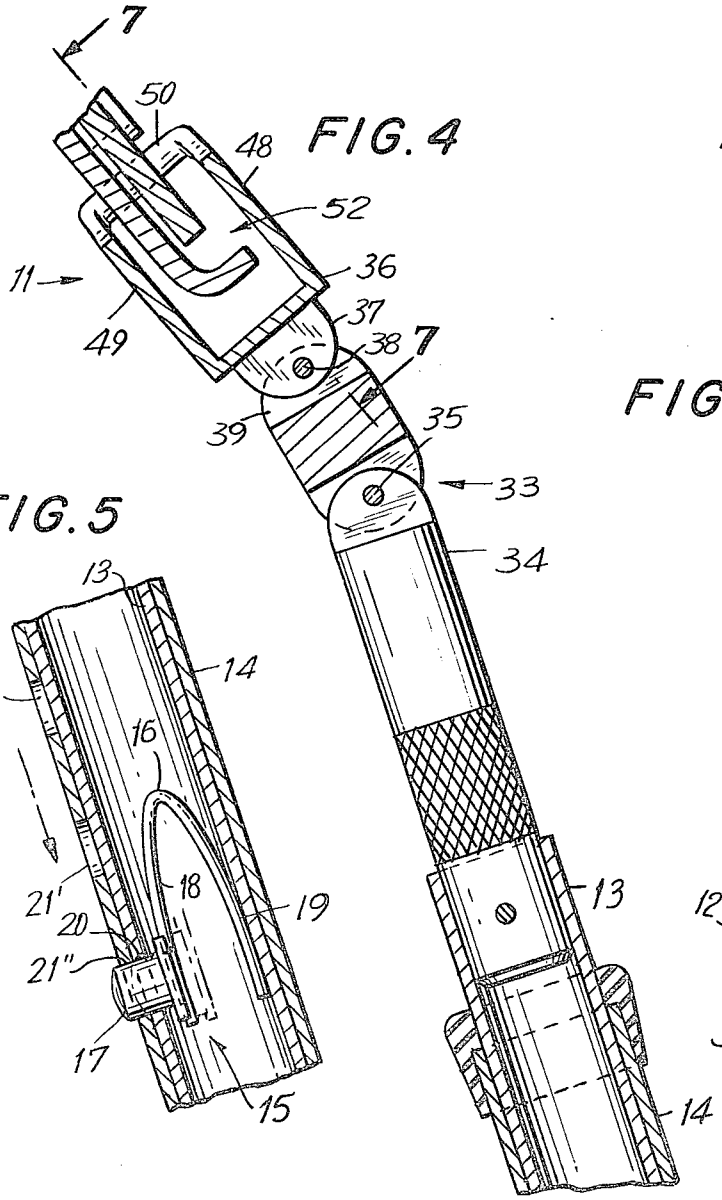
FIG. 4 is a magnified fragmentary vertical section taken on the line 4—4 of FIG. 2.

The strike plate engaging portion 12 includes a clamp assembly 22 affixed to a short section 23 pivotally connected to the outer tubular section 14 as by a knuckle or pivot assembly 24—see FIG. 6. Preferably, the knuckle or pivot assembly may include upper and lower plug portions 25, 26, respectively, fixedly secured to the sections as by pins 27, 28, respectively. A leaf member 29, secured to plug 26, extends between spaced leaves 30, 31 depending from plug 25, the overlapping areas of the leaves being connected by a pivot pin 32, permitting relative articulation of the sections 23 and 14 about axis of the pivot 32. In similar fashion, knuckle or hinge assembly 33 is formed at the upper end 34 of the upper section 13 of the tube, providing pivotal movement about the axis of pivot pin 35.

A strike bolt receiver cage 36 includes a depending leaf 37 secured, as by pivot pin 38, between the spaced leaves 39, 40 of the upper hinge assembly 33. The pivot axes of the pins 38, 35 and 32 are parallel, whereby it will be understood that the cage 36 and lower section 23 of the strut assembly may be articulated relative to the main body of the strut within a plane normal to the pivot axes 38, 35 and 32.

The clamp assembly 22 formed in the lower end of the short tubular section—see FIG. 6—is comprised of a lower clamp plate 41 formed on the lower end of a threaded stud 42, the upper end 43 of which is fixed to a tubular plug 44 extending below the tubular section 23. The plate 41 is rectangular in plan.

A locking member 45 is threadedly mounted on the stud 42 for movement toward and away from the plate 41. The locking member includes a knurled portion 46 having at its lower end a locking flange 47 shiftable toward and away from the plate 41 by threading and unthreading the same along the stud 42.

The locking cage 36 at the upper end of the strut assembly defines a box-like configuration including side flanges 48, 49, the flanges being spanned at the upper ends thereof by a latch bolt receiver bar 50.

The device is applied between fixed strike plate portion 51 of a conventional trunk lock assembly and the latch bolt component 52 thereof.

Figure 1:
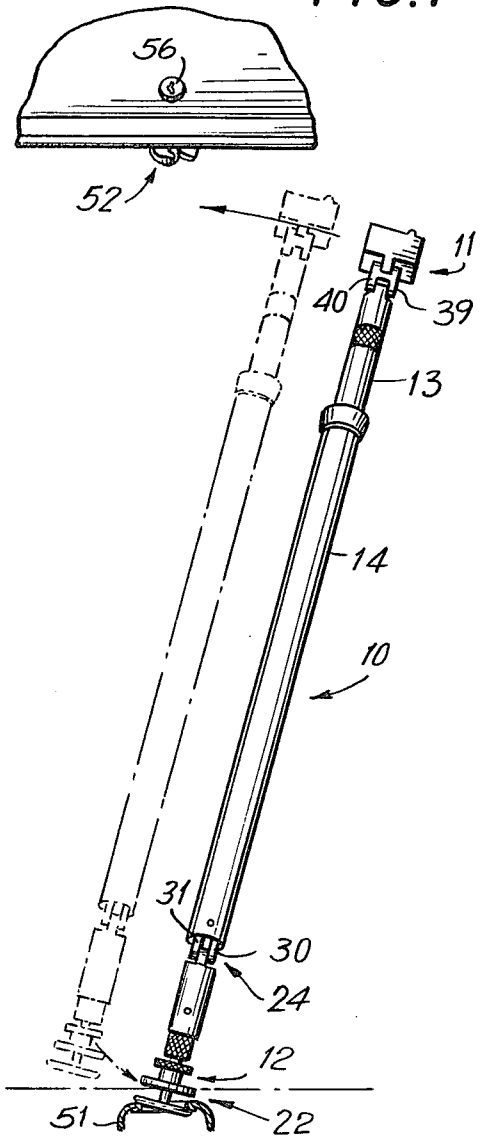
Figure 8:
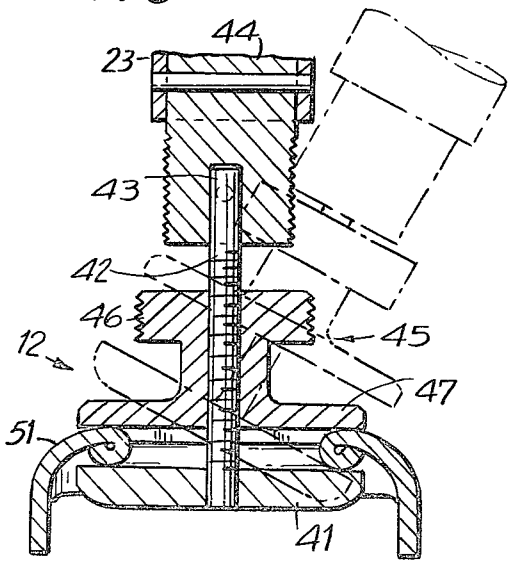
FIG. 8 is a sectional view taken on the line 8—8 of FIG. 6.

Application of the device is effected by threading the locking member 45 in such manner as to space the flange 47 from the clamp plate 41. With the parts thus spaced, the clamp assembly is secured to the strike plate assembly by bodily tilting the entire strut—see FIG. 1 and dot and dash view, FIG. 8—in such manner that the clamp plate 41 may be passed through the aperture 53 in the strike plate assembly 51, slid laterally so as to clear the other end of the plate 41, for passage through the aperture 53. When the plate 41 is disposed entirely below the strike plate 51, the strut assembly is returned to a vertical position whereat the plate 41 will underlie the strike plate 51, preventing upward withdrawal of the clamping assembly from the strike plate so long as the strut assembly remains in an essentially vertical orientation.

The locking member 45 is thereafter threaded toward the lock plate 41 so as to clamp the strike plate 51 between the lock plate 41 and the flange 47 of the lock member. Thereafter, the length of the overlap of the tubular sections 13 and 14 is adjusted as hereinabove described in accordance with the dimensions of the articles to be transported, and the cage member 36 carrying the latch bolt receiver bar 50 is shifted, by articulation of the various pivotally connected components, so as to lie in position immediately beneath the latch bolt assembly 52 of the trunk lid. With the parts thus positioned, the trunk lid is closed, causing the latch bolt assembly 52 to enter into the cage 36.

Figure 7:
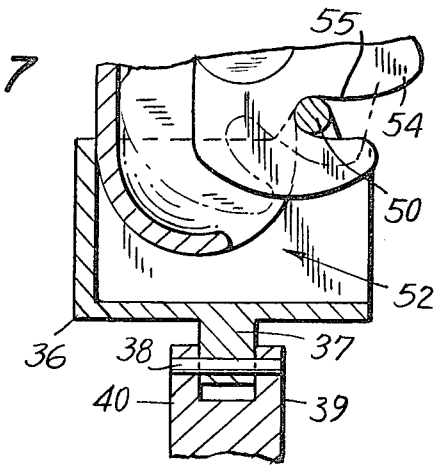
FIG. 7 is a sectional view taken on the line 7—7 of FIG. 4.

In FIG. 7 the swingable latch bolt member 54 is shown in the unlocked or unsecured position (dot and dash lines) and in the locked position (solid lines). As will be evident from FIG. 7, the bar 50, in the course of closing movements of the trunk lid, will enter the arcuate locking slot 55 of the conventional latch bolt assembly 54, causing the same to pivot from the dot and dash to the solid line locked position.

As is known, when the latch bolt 54 is in the solid line position, the lock mechanism 56 of the car prevents the bolt from being retracted without the use of a key.

It will further be observed that once the lock bar 50 is captured within the arcuate slot 55, transverse tilting movement from the vertical of the strut assembly is positively prevented. Since the clamp plate 41 can be removed from the strike plate 51 only after the components are tilted and since the lock mechanism will prevent the upper end of the strut assembly from such tilting movement, it will be evident that the trunk lid cannot be opened without the use of the trunk lid key.

The security feature noted is achieved notwithstanding the threaded position of the locking member 45 since, even if such a member is unthreaded, tilting of the strut is precluded. The locking member 45 does, however, provide a tight connection between the clamp assembly 22 and the strike plate assembly whereby rattling of the components is prevented.

By permitting articulation between the various sections noted but limiting such articulation to an essentially vertical plane paralleling the longitudinal axis of the automobile, the device is enabled to be accommodated to trunk assemblies having various lid sizes and configurations.

In the event that the device is to be used with an automobile having a strike and lock configuration of grossly different size than convenient, it is merely necessary to substitute appropriate fittings at the extremities of the strut assembly.

By way of example, many automobiles employ as the strike member a bar in the form of an inverted U oriented in a fore and aft direction, the branch of the U being encompassed in the latch bolt in the locked position of the lid. With such lock arrangement, the clamp plate 41 may take the form of a hook partially encircling the strike, the hook being insertible behind the strike only in a tilted position.

The articulation feature of the device is particularly important when the device is applied to the rear deck of a so-called hatchback automobile since the angular orientation of the deck parts, in the open and closed positions, vary widely.

As will be apparent to those skilled in the art and familiarized with the instant disclosure, numerous variations may be made in the details of construction of the illustrated embodiment without departing from the spirit of the invention. Accordingly, the invention is to be broadly construed within the scope of the appended claims.

Having thus described the invention and illustrated its use, what is claimed as new and is desired to be secured by Letters Patent is:

1. A lockable extension device for use with an automobile having a trunk or deck compartment member and a hinged trunk lid member shiftable between an open position and a locked compartment sealing position, one of said members including a key actuated latch bolt and the other said member including a generally horizontally disposed strike adapted to be coupled with said latch bolt, said device comprising a rigid strut member, extension means on said strut member for axially extending and contracting said strut member, pivot means including a first pivot joint adjacent one end of said strut member, a second pivot joint adjacent the other end of said strut member, said pivot joints having parallel pivot axes normal to the longitudinal axis of said strut for enabling articulation of said member in a single plane, clamp means at the lower end of said strut member adapted to be engaged with said strike responsive to tilting movements of said strut member in a direction normal to the plane of articulation of said strut member and to be fixedly connected against removal from said strike when said strut member is disposed in a vertical plane, latch bolt receiver means at the other end of said strut member adapted to be lockingly engaged with said latch bolt, said latch bolt receiver means comprising a bar member disposed in an essentially vertical plane aligned with the longitudinal axis of said strut member in the applied position of said device, the connection between said latch bolt and latch bolt receiver means locking said latch bolt receiver means against movements of said strut member from a vertical plane, thereby to prevent tilting of said clamp means relative to said strike.

2. An extension device in accordance with claim 1 wherein said extension means comprises first and second telescoped strut sections together defining said strut member, and locking means for securing said sections in a selected telescoped orientation.

3. A lockable extension device for use with an automobile having a trunk or deck compartment member and a hinged trunk lid member shiftable between an open position and a locked compartment sealing position, one of said members including a key actuated latch bolt and the other said member including a generally horizontally disposed strike adapted to be coupled with said latch bolt, said device comprising a rigid strut member, extension means on said strut member for axially extending and contracting the same, pivot means interposed between the ends of said strut member for enabling articulation of said member limited to a single plane, clamp means at one end of said strut member adapted to be engaged with said strike responsive to tilting movements of said strut member in a direction normal to the plane of articulation of said strut member and to be fixedly connected against removal from said strike when said strut member is disposed in a vertical plane, and latch bolt receiver means at the other end of said strut member adapted to be lockingly engaged with said latch bolt, the connection between said latch bolt and latch bolt receiver means locking said latch bolt receiver means against movements of said strut member from a vertical plane in directions normal to said plane of articulation, thereby to prevent tilting of said clamp means relative to said strike in directions normal to said plane of articulation.

* * * * *